United States Patent [19]

Dashley et al.

[11] Patent Number: 4,607,647

[45] Date of Patent: Aug. 26, 1986

[54] SMOKING ARTICLES

[75] Inventors: Frederick J. Dashley, New Milton; David J. Dittrich, Southampton, both of England

[73] Assignee: British-American Tobacco Company Limited, London, England

[21] Appl. No.: 619,058

[22] Filed: Jun. 11, 1984

[30] Foreign Application Priority Data

Jun. 15, 1983 [GB] United Kingdom ..... 8316266

[51] Int. Cl.[4] ..... A24B 15/28

[52] U.S. Cl. ..... 131/365; 131/358

[58] Field of Search ..... 131/332, 365, 358, 352

[56] References Cited

U.S. PATENT DOCUMENTS

| | | | |
|---|---|---|---|
| 3,744,496 | 7/1973 | McCarty et al. | 131/365 |
| 4,306,059 | 12/1981 | Yokobayashi et al. | 131/352 |
| 4,340,074 | 7/1982 | Tudor | 131/365 |
| 4,407,308 | 10/1983 | Baker et al. | 131/365 |
| 4,452,257 | 6/1984 | Cartwright et al. | 131/352 |

*Primary Examiner*—V. Millin

*Assistant Examiner*—H. Macey

*Attorney, Agent, or Firm*—Kane, Dalsimer, Kane, Sullivan and Kurucz

[57] ABSTRACT

The smoking articles, such as cigarettes, comprise smoking material wrapped in a low side stream wrapper paper incorporating or being coated with a stain resist substance, such as EVA (ethylene vinyl acetate).

13 Claims, No Drawings

SMOKING ARTICLES

The present invention relates to smoking articles and paper for smoking articles. The smoking articles, cigarettes for example, comprising smoking material wrapped in wrapper paper selected to effect a low delivery of total particulate matter (TPM) in the sidestream smoke of the smoking articles as compared with that delivered from smoking articles comprising conventional wrapper paper.

One method of providing a cigarette paper which effects a reduced delivery of sidestream TPM is to specify for the paper a low air permeability. For details of low permeability, low sidestream TPM cigarette papers, reference may be made to United Kingdom Patent Specification No. 2,094,130A. A low sidestream cigarette paper may also be provided by incorporating in the paper a sidestream reducing compound or compounds. Exemplary of this second approach to sidestream TPM reduction are cigarette papers described in U.S. Pat. No. 4,231,377. These two modes of effecting sidestream TPM reduction are not mutually exclusive.

For purposes of the present application, the term "low sidestream paper" refers to smoking article wrapper paper which effects at least a 30% reduction in the rate of production of sidestream TPM as compared with a conventional wrapper paper.

It has been observed that, when some cigarettes having low sidestream paper are smoked, whether machine smoked or smoked by the consumer, the cigarette paper becomes stained in a circumferential zone extending from, or at a location spaced from, the burn line of the paper. This phenomenon is not restricted to cigarettes of any particular type of tobacco filler. It has been observed in relation to cigarettes comprising three respective types of tobacco filler blend, namely fluecured, air-cured and so-called American type. The staining, which can extend up to 20 mm from the burn line, is thought to result from the penetration of the cigarette paper by smoke condensate. The occurrence of staining tends to diminish consumer acceptance of smoking articles incorporating low sidestream papers and it is thus an object of the present invention to provide means whereby the staining phenomenon can be eliminated, or at least substantially alleviated.

The present invention provides a low sidestream paper for a smoking article, the paper having an air permeability of less than 10 CORESTA units and including a substantially uniform distribution of a stain resist substance.

The present invention also provides a cigarette or other smoking article comprising smoking material wrapped in low sidestream paper of an air permeability of less than 10 CORESTA units, which paper has a substantially uniform distribution of a stain resist substance.

The distribution level of the stain resist substance may be as high as, for example, 20 grams per square meter, but should preferably not exceed about 5 grams per square meter. Suitably, the distribution level of the stain resist substance should not substantially exceed the minimum level determined to effect acceptable stain elimination of alleviation.

Suitable substances found to have the necessary stain resist property include ethylene vinyl acetate (EVA), polyvinyl acetate (PVA), cationic starch, cold water starch, polyvinyl alcohol (PVOH), carboxmethyl cellulose (CMC) and nitro-cellulose lacquer. These substances may be applied as a coating to the paper in emulsion solution or other suitable form.

The stain resist substance may be coated on either side of the paper, but is preferably applied to that side which is intended to be the inner side of the paper when the paper is incorporated in a smoking article. It is suitably coated over the whole of the tobacco contacting surface at the side of the paper to which it is applied, rather than being restricted to selected area thereof.

An alternative way of incorporating the stain resist substance in the paper is to add it to the paper at the paper making stage.

The stain resist substance may consist of a combination of one or more such individiual substances. Furthermore, the stain resist substance may be combined with one or more additional substance which are intended, for example, to enhance the coating properties of the stain resist substance, to reduce sidestream TPM, to promote or retard the burn rate of the paper or to modify the flavour of mainstream smoke.

When a stain resist substance is coated onto paper, the initial, i.e. uncoated, permeability value of the paper is reduced, the degree of reduction in any particular case being dependent upon the substance concerned and the distribution level of the substance. Thus it is necessary to select a paper having such initial permeability that the coating of the paper at the specified coating level results in a final permeability in accordance with the specified for the low sidestream paper. Thus, for example, if it is required that the permeability of the coated paper is 5 CORESTA units and a coating level of 2 grams per square meter of EVA is used, it is necessary to select a paper with an initial permeability of about 50 CORESTA units. Preferably, the final permeability of the paper should not exceed 6 CORESTA units.

If the paper is white it is advantageous for the stain resist substance to be white or colourless in order that the incorporation of the substance with the paper does not result in an apparent discoloration of the paper.

Suitably, a low sidestream paper should effect at least a 50% reduction in the rate of production of sidestream TPM as compared with a conventional wrapper paper.

EXAMPLE 1

Plain, 70 mm long test cigarettes were made using a flue-cured tobacco and cigarette paper supplied by Papeteries de Mauduit SA under type designation 556 NI. The cigarette paper as supplied had a permeability of 27 CORESTA units. Before being utilized in the making of the cigarettes the paper was coated with a 4.5% aqueous emulsion of EVA to give, after drying, a distribution of EVA of 2.4 grams per square meter. The permeability of the paper was found to have been reduced by the application of the EVA to about 3 CORESTA units. The cigarettes were made with the EVA coating disposed at the inner side of the cigarette paper.

Upon machine smoking the cigarettes, it was determined that the rate of production of sidestream TPM, i.e., the total sidestream TPM emission per cigarette divided by the time taken for the cigarette to burn to a 23 mm butt length when smoked under the standard conditions of a 35 ml puff of 2 seconds duration every minute, was 1.7 mg $min^{-1}$, this being 41% less than the rate of production of sidestream TPM for cigarettes which were identical with the test cigarettes except that the 556 NI cigarette paper thereof was uncoated. Thus the coated cigarette paper was clearly a low sidestream paper. It was observed that through-out the smoking of the text cigarettes the cigarette paper did not become stained.

EXAMPLE II

Test cigarettes were made which were identical with the test cigarettes of Example I excepting that the cigarette paper was of an initial permeability of about 3 CORESTA units and was not coated. The rate of production of sidestream TPM was found to be 1.4 mg $min^{-1}$. Just after the end of the second smoking puff of each cigarette there was observed to develop a circumferential zone of patch staining of the cigarette paper, which zone extended four about 5 mm from the burn line. It was observed that the cigarette paper consumed during the third smoking puff accounted for about half the lengthwise extent of the stain zone and the shortly after the end of the third puff, the remaining portion of the stain zone became extended by the development of further staining. This process was repeated during the subsequent smoking of the cigarette.

In smoking cigarettes similar to the test cigarettes excepting that the inner sides of the cigarette papers were coated with EVA at a distribution level of 2.8 grams per square meter, it was observed that no staining occurred. The coated paper had a permeability of about 0.3 CORESTA units. The rate of production of sidestream TPM of the cigarettes was found to be 0.9. mg $min^{-1}$.

EXAMPLE III

Test cigarettes were made which were identical with the test cigarettes of Example I except that the cigarette paper used has an initial permeability of 4 CORESTA units and contained 10% of a citrate burn promoter. The cigarette papers of half of these cigarettes were coated with a 5% aqueous emulsion of EVA to give, after drying, a distribution of EVA of 2.9 grams per square meter and a reduction in permeability to 0.2 CORESTA units. The papers of the remaining cigarettes were left uncoated. The rate of production of sidestream TPM for the cigarettes with coated paper was found to be 1.0 mg $min^{-1}$, whereas that for those with uncoated paper was 1.5 mg $min^{-1}$. The uncoated papers exhibited staining. No staining was observed in the coated papers.

Rates of production of sidestream TPM in the above examples were determined by use of a method as follows. Each cigarette was smoked in accordance with the regime defined in Example I, while extending into a vertical flask through an aperture in the wall thereof, which aperture was fitted with a cigarette contacting seal. An 82 mm diameter Cambridge filter pad was fitted across the upper opening of the flask. Air and sidestream smoke were drawn upwardly through the filter pad under the action of an air pump. The flow of air induced by the pump to flow into a lower opening of the flask was maintained at 1 liter $min^{-1}$. By weighing the filter pad before and after the smoking of the cigarette, a determination was made of the amount of sidestream smoke TPM emitted by the cigarette.

What is claimed is:

1. A smoking article wrapping paper which effects at least thirty percent reduction of side stream TPM as compared with a conventional wrapper paper, the paper having an air permeability of less than 10 CORESTA units and including a stain resist substance substantially uniformly distributed substantially throughout the paper.

2. A paper as claimed in claim 1 wherein the distribution level of the stain resist substance is up to 20 grams per square meter.

3. A paper as claimed in claim 2 wherein the distribution level of the stain resist substance does not exceed 5 grams per square meter.

4. A paper as claimed in claim 1 wherein the stain resist substance consists of one of, or a combination of ethylene vinyl acetate (EVA), polyvinyl acetate (PVA), cationic starch, cold water starch, polyvinyl alcohol (PVOH) carboxmethyl cellulose (CMC) and nitro-cellulose lacquer.

5. A paper as claimed in any one of claims 1 or 2–4 inclusive wherein the stain resist substance is incorporated in the paper as an ingredient during the manufacture thereof.

6. A paper as claimed in claim 1 wherein the stain resist substance is supplied as a coating to the paper as an emulsion or solution.

7. A paper as in any of claims 1 or 2–6 wherein said paper is to be formed into a cylindrical tube the stain resist substance is applied to that side of the paper which comprises the interior of said tube.

8. A smoking article comprising smoking material and wrapper paper circumscribing the smoking material, the wrapper paper comprising a paper which effects at least thirty percent reduction of side stream TPM as compared with a conventional wrapper paper, having an air permeability of less than 10 CORESTA units and including a stain resist substance substantially uniformaly disstributed substantially throughout the paper.

9. A smoking article as claimed in claim 8 wherein the stain resist substance is incorporated as an ingredient in the paper during the manufacture thereof.

10. A smoking article as claimed in claim 9 wherein the distribution level of the stain resist substance does not exceed 5 grams per square meter.

11. A smoking article as claimed in claim 8 wherein the stain resist substance consists of one of, or a combination of ethylene vinyl acetate (EVA), polyvinyl acetate (PVA), cationic starch, cold water starch, polyvinyl alcohol (PVOH), carboxmethyl cellulose (CMC) and nitro-celluose lacquer.

12. A smoking article as claimed in claim 8 wherein the stain resist substance is applied as a coating to the paper as an emulsion or solution.

13. A smoking article as claimed in any one of claims 8 to 12 inclusive wherein the stain resist substance is applied to that side of the paper which comprises the inner side when the paper is incorporated in a smoking article.

* * * * *